US005461413A

United States Patent [19]

Askinazi et al.

[11] Patent Number: 5,461,413

[45] Date of Patent: Oct. 24, 1995

[54] LASER ARRAY PRINTING

[75] Inventors: Martin Askinazi, Freehold; Herbert O. Burton, Little Silver, both of N.J.

[73] Assignee: AT&T IPM Corp., Coral Gables, Fla.

[21] Appl. No.: 175,662

[22] Filed: Dec. 30, 1993

Related U.S. Application Data

[63] Continuation of Ser. No. 733,786, Jul. 22, 1991, abandoned.

[51] Int. Cl.[6] ..... B41J 2/435

[52] U.S. Cl. ..... 347/243

[58] Field of Search ..... 346/108, 107 R, 346/761, 1.1, 160; 358/296; 347/243, 241, 256, 258, 259, 260

[56] References Cited

U.S. PATENT DOCUMENTS

| | | | |
|---|---|---|---|
| 4,428,647 | 1/1984 | Sprague et al. | 350/167 |
| 4,791,650 | 12/1988 | Tatsuno et al. | 372/50 |
| 4,796,964 | 1/1989 | Connell et al. | 359/204 |
| 4,988,153 | 1/1991 | Paek | 350/3.8 |
| 4,989,019 | 1/1991 | Loce et al. | 346/108 |

*Primary Examiner*—Mark J. Reinhart
*Attorney, Agent, or Firm*—Joseph J. Opalach

[57] ABSTRACT

A monolithic array of surface emitting lasers is used in a printer engine to illuminate a photosensitive surface.

8 Claims, 2 Drawing Sheets

LASER ARRAY PRINTING

This application is a continuation of application Ser. No. 07/733,786, filed on Jul. 22, 1991, now abandoned.

BACKGROUND OF THE INVENTION

The present invention relates to non-impact printers and, more particularly, to laser printers.

As a result of both improvements in technology and reductions in price, non-impact printers have grown in popularity over the recent years. For example, it is now possible for a small business, or even an individual, to purchase a non-impact printer which, in conjunction with a word processing system, can produce high-quality announcements, letters, reports, etc., that were previously only available from other sources such as an outside printing shop. Currently, non-impact printers cover a range of technologies, e.g., electrophotographic, metal drum, and ink jet printers. However, the best known of these are the electrophotographic printers, i.e., the laser and light-emitting-diode (LED) printers.

Both the laser- and LED-based printers have the same goal, which is to scan an image with light onto a photosensitive surface. The photosensitive surface is usually a photo-drum which is electrically charged and draws toner to the charged areas which is then applied to a page and fused by heat.

A laser printer is built around a "printer engine" which includes a semiconductor laser and a rotating scanning mechanism (e.g., a rotating mirror). As the scanning mechanism rotates, it deflects a light beam from the semiconductor laser across the photo-drum thereby scanning a line of images onto the photo-drum. Unfortunately, the laser printer engine is subject to a number of limitations as a result of the scanning mechanism. Specifically, the presence of the scanning mechanism means that the laser printer will be sensitive to vibration. It also has an effect on the printer's reliability (due to the moving parts of the scanning mechanism), and, more importantly, results in a basic limitation on the printing speed, the latter being limited by the rotation speed of the scanning mechanism.

As a result, those in the art have addressed these limitations by offering various alternative designs for laser-based printers. For example, U.S. Pat. No. 4,445,125 issued Apr. 24, 1984 to Scifres et al. discloses a laser array and a scanning mechanism which can illuminate a plurality of lines on the photosensitive medium; U.S. Pat. No. 4,786,918 issued November 1988 to Thornton et al. discloses a plurality of lasers, used as a single light source, which uses a total internal reflection (TIR) line modulator for spacial modulation and a plurality of focusing lenses; and U.S. Pat. No. 4,900,130 issued Feb. 13, 1990 to D. Haas discloses a plurality of light sources and a scanning mechanism which is further modified to move transversely in respect to the photo-drum.

In contradistinction, an LED-based printer employs a stationary panel, or array, of light sources in which a separate diode is used as a source of light for each dot that comprises an image. The stationary panel of LEDs is as wide as the width of the paper, so that there is a 1:1 relationship between the size of the dots that comprise the image and the discrete LEDs which comprise the panel. In addition the stationary panel must be mounted close to the photosensitive medium, or photo-drum, due to power considerations inherent in the use of LEDs as a light source. As a result of the use of such a stationary panel, an LED-based printer can offer increased printing speeds compared to a laser-based printer since there is no time required to scan a light source across the photo-drum, and may be more reliable than a laser printer due to the lack of the rotating scanning mechanism. Unfortunately, problems may exist in the construction of the stationary panel due to its size (e.g., the width of a panel to cover a letter-size paper is eight inches). In addition, LEDs as a light source offer less resolution than is possible with a laser-based printer.

Notwithstanding some of these limitations, LED-based printers are currently becoming more popular in the marketplace than laser-based printers due to the increased printing speeds mentioned above. This has resulted in electrophotographic printer manufacturers beginning to focus more efforts on the further development of LED-based printers.

SUMMARY OF THE INVENTION

In accordance with the invention, we have come to realize that by utilizing a monolithic integrated circuit which is comprised of an array of so-called surface emitting lasers it is possible to construct a laser printer engine which does not require either a rotating scanning mechanism or modulation of the laser array output. Elimination of the scanning mechanism not only eliminates a moving part but results in a laser printer that is capable of a printing speed comparable to that of an LED printer but with higher resolutions. In addition, by using an array of surface emitting lasers, additional system design components (such as a line modulator) are eliminated since spatial modulation of the light output is not required.

In preferred embodiments of the invention, a monolithic integrated circuit is comprised of a one-dimensional array of surface emitting lasers, where the size of the array, or the number of surface emitting lasers, is such that a line of data is stored. The light output from the array of lasers, representing the line of data, is then optically magnified before scanning a line of images onto a photosensitive surface.

DETAILED DESCRIPTION

Figure 1:
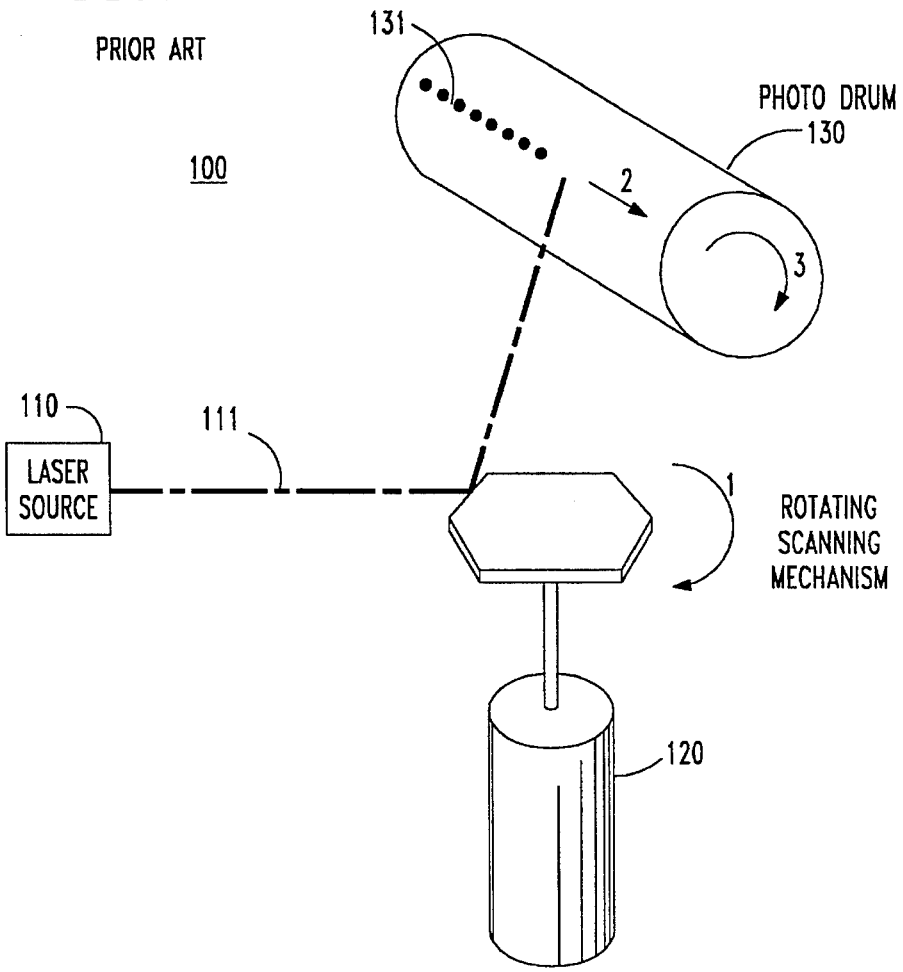
FIG. 1 PRIOR ART
FIG. 1 is a block diagram of an illustrative laser printer engine as known in the prior art.

Although in the prior art there are a number of different variations in the design of a laser printer engine (e.g., see U.S. Pat. No. 4,760,407 issued Jul. 26, 1988 to Arimoto et al.; U.S. Pat. No. 4,941,004 Jul. 10, 1990 to Pham et al., and the previously mentioned U.S. patents issued to Scifres et al., and Haas.), the general concept is illustrated in FIG. 1. Laser source 110 is a single semiconductor injection diode laser which provides laser beam 111 to rotating scanning mechanism 120. Rotating scanning mechanism 120 deflects laser beam 111 across photo-drum 130 thereby scanning an image onto photo-drum 130. As used herein, the term "scanning an image" means any technique for creating an image on a photosensitive surface. In light of the aforementioned structure of FIG. 1, photo-drum 130 is constantly electrostatic ally charged so that when laser beam 111 scans across photo-drum 130, the electrostatic charge is dissipated in accordance with the light intensity of laser beam 111, thereby creating an image on photo-drum 130. As rotating scanning mechanism 120 continues to rotate in the direction indicated by arrow 1, an image continues to be scanned onto photo-drum 130 in the direction indicated by arrow 2 to provide a line of images 131. The line of images 131 is illustratively comprised of a plurality of dots. As photo-drum 130 continues to rotate in the direction indicated by arrow 3, additional lines of images are scanned so that, for example, images of text characters will appear on photo-drum 130 due to the combinations of the various ones of the plurality of dots. It should be noted that in order to simplify the description, a number of elements—all well-known in the art—have been intentionally left out. For example, the method of rotation of photo-drum 130 to scan additional lines, the provisioning of information to laser source 110 in order to provide the data representative of the particular images of what is actually being scanned onto photo-drum 130, and the transfer of the image to a suitable medium such as a piece of paper.

Figure 2:
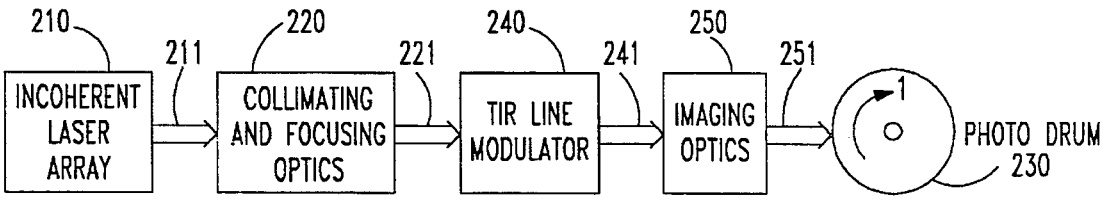
FIG. 2 PRIOR ART
FIG. 2 is a block diagram of another illustrative laser printer engine as known in the prior art.

The U.S. patent issued to Thornton et al., discloses an alternative laser printer engine design which is illustrated in FIG. 2. Laser array 210 is comprised of a plurality of laser sources such that the light output from any one of the plurality of lasers differs in phase from the light output from any other one of the plurality of lasers, i.e., laser array 210 is incoherent (as opposed to coherent-where there is no difference in phase between the light outputs of any one of the lasers). Laser array 210 provides a plurality of laser beams which are sequentially input to collimating and focusing optics 220. The output of the latter, a sheet-like beam of light, is uniformly applied to total internal reflection (TIR) line modulator 240, which is illustratively a solid state multigate light valve. TIR line modulator 240 spatially modulates the plurality of laser beams, from laser array 210, in accordance with any information to be printed. Its output in turn is applied to imaging optics 250 which scans a line of images onto rotating photo-drum 230.

In accordance with the invention, we have come to realize that by utilizing a monolithic integrated circuit which is comprised of an array of surface emitting lasers it is possible to construct a laser printer engine which does not require either use of a rotating scanning mechanism or spatial modulation of the laser array output. Elinfination of the scanning mechanism not only eliminates a moving part but results in a laser printer that is capable of a printing speed comparable to that of an LED printer but with higher resolutions. In addition, by using a surface emitting laser array, additional system design components (such as a line modulator) are eliminated since spatial modulation of the light output is not required.

A monolithic integrated circuit which is comprised of an array of surface emitting lasers (hereinafter referred to as an "SEL array") is described in such United States Patents as: U.S. Pat. No. 4,718,070, issued Jan. 5, 1988 to Liau et al.; U.S. Pat. No. 4,901,329, issued Feb. 13, 1990 to J. M. Leas; U.S. Pat. No. 4,949,350, issued Aug. 14, 1990 to Jewell et al.; and U.S. Pat. No. 4,956,844, issued Sep. 11, 1990 to Goodhue et al. All of the above are hereby incorporated by reference.

Figure 3:
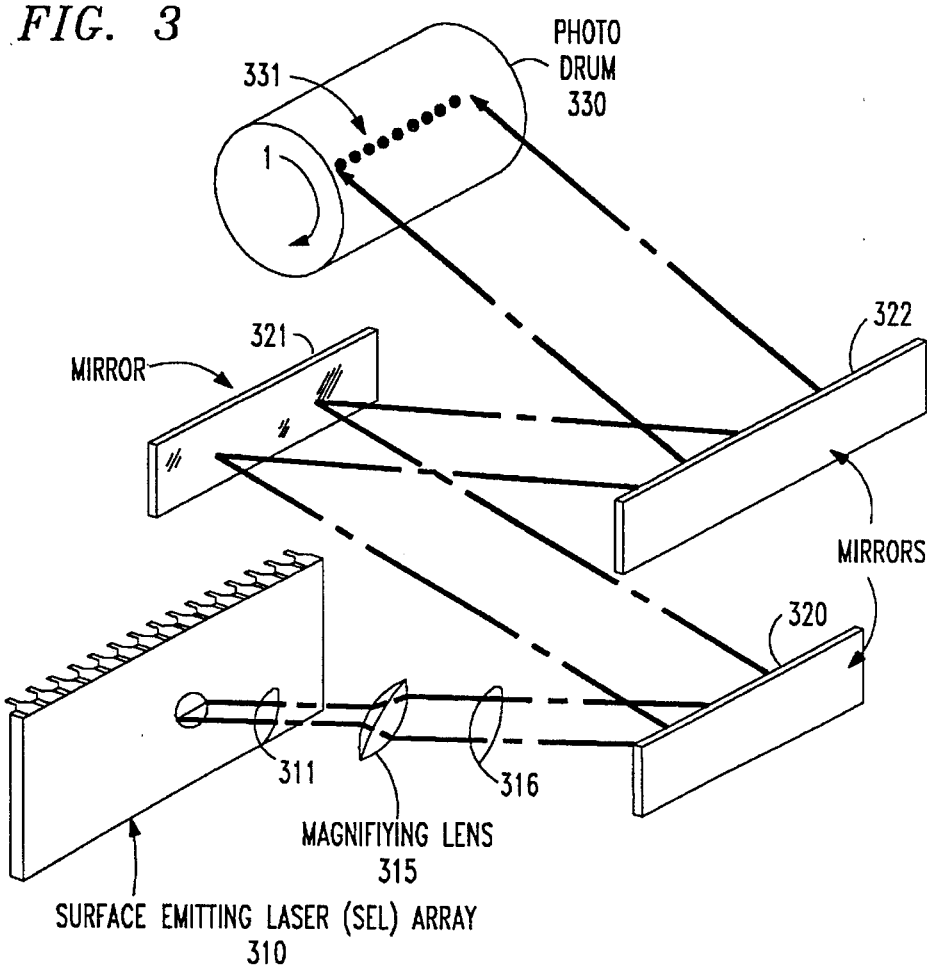
FIG. 3 is a diagram of an illustrative laser printer engine embodying the principles of the invention.

An illustrative diagram of a laser printer engine embodying the principles of the invention is shown in FIG. 3. SEL array 310 provides a plurality of laser beams 311 to magnifying lens 315. Magnifying lens 315 enlarges the images represented by the plurality of laser beams 311 to provide a plurality of laser beams 316 to stationary mirrors 320 to 322. For example, if the width of the plurality of laser beams 311 is x=0.8 inches and the desired width of a line of images on a sheet of letter size paper is y=8 inches, then the magnification of magnifying lens 315 is 10, i.e., y/x=8/0.8. Stationary mirrors 320 to 322 reflect the plurality of laser beams 316 to photodrum 330 whereupon the plurality of laser beams 316 scans a line of images 331 onto photo-drum 330.

In actuality, the magnification actually used, i.e., y/x, could also be varied in order to accommodate different sizes of paper, or the ability to scale the images to an appropriate size for a given size paper. In addition, the plurality of mirrors 320, 321, and 322 is illustratively used in the embodiment of FIG. 3 in order to keep the physical size of the laser printer engine small, i.e., to provide the appropriate length of optical path for the plurality of laser beams 316 due to the focal length of magnifying lens 315. However, depending upon the physical size of the laser printer engine required, the number of mirrors (if any), or their equivalent, will vary.

Figure 4:
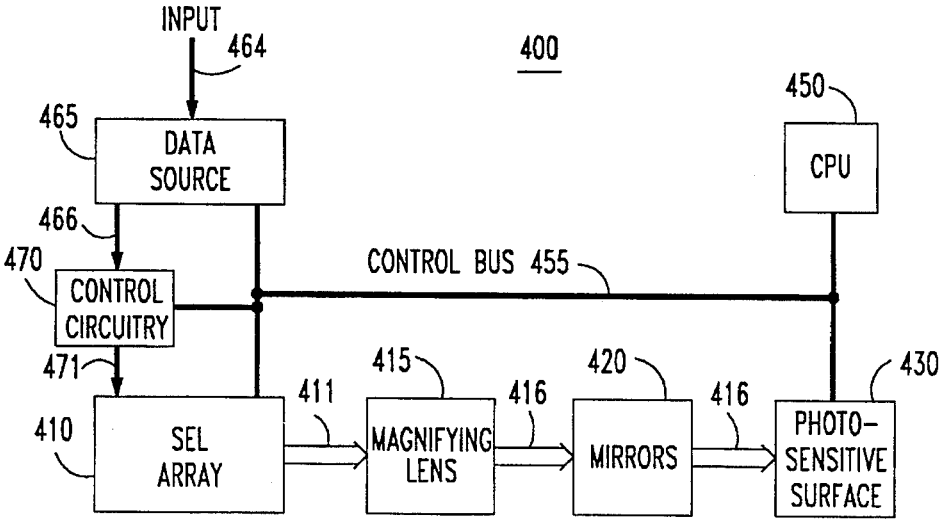
FIG. 4 is a block diagram of an illustrative laser printer embodying the principles of the invention.

An illustrative block diagram of a laser printer embodying the principles of the invention is shown in FIG. 4. Laser printer 400 is comprised of CPU 450, data source 465, control circuitry 470, SEL array 410, magnifier 415, mirrors 420 and photosensitive surface 430. CPU 450 is representative of a microprocessor-based central processing unit and associated memory (either random access memory or read only memory) which controls data source 465, control circuitry 470, SEL array 410 and photo-sensitive surface 430, via control bus 455. Although the term "control bus" is used herein to emphasize that CPU 450 is controlling the operation of printer 400, control bus 455 is itself comprised of address, data, and signalling leads (e.g., read, write, etc.) and other circuit elements as is well-known in the art. Data source 465 is representative of any of the well-known methods for inputing information to laser printer 400, via input 464, and storing data representative of that information. For example, in order to print a text character, the character itself is typically comprised of a plurality of rows, with each row being comprised of a plurality of dots (the actual placement of the dots on each row which comprises a character determines the character to be printed). If the information input to data source 465 is a sequence of text characters for a line of text, then data source 465 will store data which is representative of the plurality of dots that comprise each row, of the plurality of rows, that comprise the sequence of text characters. Data source 465 provides the data to control circuitry 470, via output 466, a row from each character in the line of text at a time. Control circuitry 470 receives each row from each character output by data source 465, up to a line of text, and provides a plurality of outputs, i.e., n outputs (471), (where n is equal to the maximum number of dots that comprise a line) to SEL array 410. SEL array 410 is a monolithic integrated circuit which is comprised of an array of coherent surface emitting lasers constructed to receive the n outputs from control circuitry 470. As used herein, an array is a two dimensional organization of the individual lasers. For the purpose of this example, the array is of a size 1×n, where 1 indicates a row of n lasers, with each laser receiving one of the n outputs from control circuitry 470. In addition, although not required, control circuitry 470 may also be comprised of a timing circuit to limit the time that SEL array 410 is energized to transmit the information represented on each one of the n outputs. SEL array 410, magnifier 415, mirrors 420, and photo-sensitive surface 430 comprise the laser printer engine, embodying the principles of the invention, which was described hereinabove and illustrated in FIG. 3. CPU 450, in accordance with well-known principles, controls the input of information, via lead 464, to data source 465, and synchronizes the operation of data source 465, control circuitry 470, and SEL array 410 with photosensitive surface 430 (e.g., as mentioned hereinabove, if photosensitive surface 430 is representative of a photo-drum, CPU 450 synchronizes the rotation of the photo-drum with the output of SEL array 410).

It will be additionally helpful to consider the operation of printer 400 in light of a specific example, i.e., for the moment consider printer 400 to be part of a FAX machine. In a typical FAX machine environment, as is known in the art, input 464 is a common tip-ring interface which provides a connection between printer 400 and a telephone central office over which information is provided in a tip-ring format. Data source 465 converts the information from the tip-ring format to a digital representation, herein termed data (e.g., binary ones and zeros) and stored in data source 465. (It is assumed herein that the information as received through input 464 further contains well-known formatting information, e.g., line delimiters (such as a carriage return).) Under control of CPU 450, data source 465 will output the data, representative of the plurality of dots for each row of each character received over tip-ring interface 464, to control circuitry 470 via lead 466. Since in this example the data is binary, output lead 466 is typically representative of a plurality of leads for transmitting the data to control circuitry 470. Control circuitry 470 will transfer the data from data source 465 to SEL array 410 a line at a time via output 471. The operation of SEL array 410, magnifying lens 415, mirrors 420 and photo-sensitive surface 430 is the same as discussed hereinabove.

The foregoing merely illustrates the principles of the invention. For instance, an SEL array can be constructed which is capable of providing multi-line images, i.e., an m x n array, where m and n are integers greater than zero, which can be used for either providing the ability to print multiple lines or provide for a level of redundancy in the operation of the SEL array in case of a single laser failure. Additionally, although an example was given in terms of the application to a FAX machine, other applications are also possible, such as in a computer printer. As a result, it should be realized that the invention is not limited to this particular embodiment and that additional embodiments, modifications and applications which will become obvious to those skilled in the an are included in the spirit and scope of the invention.

We claim:

1. A primer engine to print a document comprising surface emitting laser array means for concurrently providing a first plurality of laser beams representative of at least a line of images where the document includes N lines;

photosensitive means; and stationary optical means operative on the first plurality of laser beams for concurrently providing a second plurality of laser beams directly to the photosensitive means, without the presence of a rotating scanning mechanism, to concurrently scan thereon the line of images wherein the stationary optical means includes at least one mirror for reflecting the second plurality of laser beams to the photosensitive means, whereby each line of the N line document is printed.

2. The printer engine of claim 1 wherein the surface emitting laser array means is a monolithic integrated circuit.

3. The printer engine of claim 1 wherein the photosensitive means is a photo-drum.

4. The printer engine of claim 1 wherein the stationary optical means is further comprised of magnifying means for the first plurality of laser beams to provide the second plurality of laser beams; and means for reflecting the second plurality of coherent laser beams to the photosensitive means.

5. Apparatus to print a document comprising means for receiving information and for providing data representative of the information;

means for receiving the data and for concurrently providing a plurality of laser beams representative of the data;

a photosensitive surface;

stationary optical means operative on the plurality of laser beams such that the plurality of laser beams is provided to the photosensitive surface, without the presence of a rotating scanning mechanism, to concurrently scan thereon a plurality of images representative of the data; and cpu means for controlling the means for receiving information, the means for receiving the data, and the photosensitive surface such that the plurality of images concurrently scanned onto the photosensitive surface represents at least a line of images of the document, where the document comprises N lines;

wherein the stationary optical means includes at least one mirror for reflecting the plurality of laser beams to the photosensitive surface, whereby each line of the N line document is printed.

6. The apparatus of claim 5 wherein the means for receiving the data is a monolithic integrated circuit array of surface emitting lasers.

7. The apparatus of claim 5 wherein the photosensitive surface is a photo-drum.

8. The apparatus of claim 5 wherein the stationary optical means is further comprised of magnifying means for enlarging the plurality of laser beams.

* * * * *